US008861778B2

(12) United States Patent
Peteul-Brouillet et al.

(10) Patent No.: US 8,861,778 B2
(45) Date of Patent: Oct. 14, 2014

(54) ELECTRODYNAMIC-TRANSDUCER MAGNETIC MOTOR

(75) Inventors: Claire Peteul-Brouillet, Viroflay (FR); Gaël Guyader, Chaudon (FR); Guy Lemarquand, Beduer (FR); Mathias Remy, Villiers-le-Bâle (FR)

(73) Assignees: Renault S.A.S. (FR); Universite du Maine (FR)

( * ) Notice: Subject to any disclaimer, the term of this patent is extended or adjusted under 35 U.S.C. 154(b) by 69 days.

(21) Appl. No.: 13/574,827

(22) PCT Filed: Feb. 9, 2011

(86) PCT No.: PCT/FR2011/050275

§ 371 (c)(1),
(2), (4) Date: Sep. 17, 2012

(87) PCT Pub. No.: WO2011/098727

PCT Pub. Date: Aug. 18, 2011

(65) Prior Publication Data

US 2012/0326532 A1 Dec. 27, 2012

(30) Foreign Application Priority Data

Feb. 10, 2010 (FR) ..... 10 50925

(51) Int. Cl.
*H04R 11/02* (2006.01)
*H04R 9/02* (2006.01)
*H04R 9/06* (2006.01)

(52) U.S. Cl.
CPC . *H04R 9/025* (2013.01); *H04R 9/06* (2013.01)
USPC ..... 381/412; 381/419

(58) Field of Classification Search
USPC ..... 381/412, 419, 421
See application file for complete search history.

(56) References Cited

U.S. PATENT DOCUMENTS

| | | | | |
|---|---|---|---|---|
| 5,317,228 | A | 5/1994 | Leupold | |
| 5,634,263 | A | 6/1997 | Leupold | |
| 5,715,324 | A * | 2/1998 | Tanabe et al. | 381/412 |
| 8,422,726 | B2 * | 4/2013 | Lemarquand et al. | 381/421 |
| 2009/0123005 | A1 * | 5/2009 | Holt et al. | 381/117 |

FOREIGN PATENT DOCUMENTS

| | | | |
|---|---|---|---|
| EP | 2 114 086 | A1 | 11/2009 |
| FR | 2 892 886 | A1 | 5/2007 |
| WO | WO 2009/133149 | | 11/2009 |

OTHER PUBLICATIONS

International Search Report May 30, 2011 issued in corresponding international patent application No. PCT/FR2011/050275.

* cited by examiner

*Primary Examiner* — Davetta W Goins
*Assistant Examiner* — Amir Etesam
(74) *Attorney, Agent, or Firm* — Ostrolenk Faber LLP

(57) ABSTRACT

The disclosure relates to an electrodynamic-transducer magnetic motor device (10) having a moving coil comprising a magnetic circuit consisting of a tied angular magnet (11), characterized in that said tied annular magnet has a hollow annular structure, said hollow annular structure comprising an annular cavity (12) connected to an upper portion (13) of an external surface (14) of said hollow annular structure by a first annular channel (15) forming a first gap in which a first winding (17) of the moving coil can move.

12 Claims, 3 Drawing Sheets

ELECTRODYNAMIC-TRANSDUCER MAGNETIC MOTOR

CROSS REFERENCE TO RELATED APPLICATIONS

The present application is a 35 U.S.C. §371 National Phase conversion of PCT/FR2011/050275, filed Feb. 9, 2011, which claims benefit of French Application No. 1050925, filed Feb. 10, 2010, the disclosures of which are incorporated herein by reference. The PCT International Application was published in the French language.

BACKGROUND OF THE INVENTION

1. Technical Field

The present invention relates to an electrodynamic-transducer magnetic motor device with a moving coil, of the type comprising a magnetic circuit consisting of an annular bonded magnet.

The invention is in particular intended to form part of an electrodynamic loudspeaker. However, the invention may be applied to any type of magnetic motor with a moving coil.

2. Related Art

An electrodynamic loudspeaker magnetic motor with a moving coil comprising a magnetic circuit formed by a bonded magnet is already known from the example provided in the patent document in the name of the Applicants published under the reference number WO2009/133149. According to this document, the conventional loudspeaker motor with permanent magnets and iron plates at the front and the rear for guiding the field lines is replaced by a bonded magnet structure in the form of a ring made of plasto-magnetic material (thermoplastic bonding material) or elasto-magnetic material (elastomer bonding material). The bonded magnets are in fact made by means of injection in a mold which may have a very large variety of forms. It is thus possible to create parts where the useful magnetic field is improved and consequently limit the leakage field which is the main defect of conventional sintered magnets.

Thus the document WO2009/133149 relates to a magnetic motor device without field plates, but where the permanent magnet is an annular bonded magnet with a particular form having a cylindrical surface and, opposite thereto, a convex surface. This document discloses in particular a magnetic device where the bonded magnet is installed inside the moving coil support, the bonded magnet having an outer cylindrical surface which extends facing the wire windings of the coil and a convex surface which extends towards the inside of the magnet. This convex surface is such that the form traced by an axial plane of the bonded magnet and the convex surface is a hemi-ellipse or a semicircle. Moreover, the outer cylindrical surface has two cylindrical parts opposite each other in relation to the mid-plane of the magnet.

In this way, along an axial plane, the field lines extend, from one side to the other inside the magnet, parallel to the curvature defined by the hemi-elliptical convex surface and intersecting substantially perpendicularly the cylindrical surface. This allows the magnetic field to be concentrated effectively towards the wire windings of the coiled support.

However, the field lines do not close up easily beyond the coiled support, opposite the magnet. Thus, the document WO2009/133149 discloses the installation of a second bonded magnet around the coil support and symmetrical in relation to the one which is housed inside so as to close up the field lines and obtain a more linear magnetic field and limit the magnetic leakages.

However, the installation of an additional magnet around the coiled support increases the weight and the volume of the magnetic motor device. In this respect, in order to achieve better integration of the electrodynamic transducer, a reduction in the magnetic mass is particularly desirable.

Moreover, simulations of the magnetic field generated inside a bonded-magnet annular structure with a semicircular or hemi-ellipsoidal form as described in the document WO2009/133149 have led to the conclusion that this form is not optimum in terms of useful magnetic field. FIG. 1 shows in this connection an example of calculation of the magnetic field obtained in a bonded-magnet annular motor 30 according to the document WO2009/133149, having an inner cylindrical surface and, opposite thereto, a convex surface which extends towards the outside of the magnet and the convex surface of which is such that the intersection of an axial plane of the bonded magnet and the convex surface is semicircular, as schematically shown in the cross section alongside the graph of FIG. 1. This bonded magnet is intended to surround the coil support so that the inner cylindrical surface extends facing the wire windings of the coil. The graph in FIG. 1 shows an example of a magnetic field expressed in Tesla (T) obtained inside this annular motor at a constant distance from the cylindrical surface, as a function of the height z expressed in millimeters of the magnet structure in relation to a mid-plane P of the structure, perpendicular to the axis of revolution Z of the magnet. The hatched zone in the graph corresponds to a zone in the center of the material of the annular motor where the magnetic field is weak or difficult to control during industrial production of the magnet.

SUMMARY OF THE INVENTION

Thus, the object of the present invention is to propose a magnetic motor device based on bonded magnets which is able to overcome at least partly the drawbacks mentioned. In particular, the present invention aims to provide a magnetic motor device which is able to reduce the weight and/or the volume of the device so as to facilitate integration thereof while having an optimized useful magnetic field.

For this purpose, the present invention, moreover according to the general definition provided in the above preamble, is essentially characterized in that said annular bonded magnet has a hollow annular structure, said hollow annular structure comprising an annular cavity connected to a top part of an outer surface of said hollow annular structure by a first annular channel forming a first air gap in which a first winding of the moving coil can move.

Owing to this arrangement, the non-useful magnetic mass at the center of the bonded-magnet annular structure, i.e. the magnetic mass corresponding to the hatched zone in FIG. 1, is eliminated, thus resulting in a certain advantage in terms of optimization of the magnetic mass.

Advantageously, the annular cavity is formed by an internal hollow volume arranged inside the solid body of the annular bonded magnet and bounded by an inner surface of the annular bonded magnet, said outer surface of the annular bonded magnet being radially at a distance from said inner surface of the annular bonded magnet and being connected to said inner surface by a solid portion of the annular bonded magnet forming a thickness of residual magnetic material between said inner surface bounding said annular cavity inside the solid body of the annular bonded magnet and said outer surface of the annular bonded magnet.

Preferably, the intersection of said inner surface and said outer surface of the annular bonded magnet respectively with an axial plane of the annular bonded magnet forms a circle.

According to a variant, the intersection of said inner surface and said outer surface of the annular bonded magnet respectively with an axial plane of the annular bonded magnet forms an ellipse.

According to a particular embodiment, said annular bonded magnet comprises a solid central core surrounded by said annular cavity.

According to this particular embodiment, said solid portion of the annular bonded magnet, in its part which is arranged substantially facing the axis of revolution of the annular bonded magnet, is designed to extend towards the central part of the annular bonded magnet in the direction of said axis of revolution, so as to form said solid central core.

Advantageously, said top part of said outer surface of the annular bonded magnet comprises a truncated zone leading into said annular cavity, said truncated zone having two cylindrical surfaces facing each other, substantially parallel to the axis of revolution of the annular bonded magnet and each extending respectively between said top part of said outer surface and said annular cavity, so as to form said first annular channel connecting said annular cavity to said top part of said outer surface of the annular bonded magnet.

In an embodiment which is especially designed for double windings, said annular cavity is connected to a bottom part of said outer surface of the annular bonded magnet, opposite said top part in relation to a mid-plane of the annular bonded magnet, by a second annular channel aligned with said first annular channel across said annular cavity and forming a second air gap inside which a second moving-coil winding can move.

Advantageously, said bottom part of said outer surface of the annular bonded magnet comprises a truncated zone leading into said annular cavity, said truncated zone having two cylindrical surfaces facing each other, substantially parallel to an axis of revolution of the annular bonded magnet and each extending respectively between said bottom part of said outer surface and said annular cavity, so as to form said second annular channel connecting said annular cavity to said bottom part of said outer surface of the annular bonded magnet.

Preferably, said solid portion of the annular bonded magnet has a variable thickness so that said annular bonded magnet has a cross section for passage of the magnetic flux corresponding to a magnetic surface resulting from the intersection of the annular bonded magnet with a plane perpendicular to the axis of revolution of the annular bonded magnet, which is constant along a vertical dimension of said annular bonded magnet.

According to a variant, said solid portion of the annular bonded magnet may have a constant thickness.

Advantageously, said top part of said outer surface of the annular bonded magnet comprises a substantially flat portion so as to facilitate assembly with other parts of the electrodynamic transducer, in particular the frame.

BRIEF DESCRIPTION OF THE DRAWINGS

Other features and advantages of the invention will emerge from a reading of the description below of a particular embodiment of the invention provided by way of a non-limiting example with reference to the accompanying drawings in which.

Common parts in the various figures have the same reference numbers.

DESCRIPTION OF PREFERRED EMBODIMENTS

Figure 1:
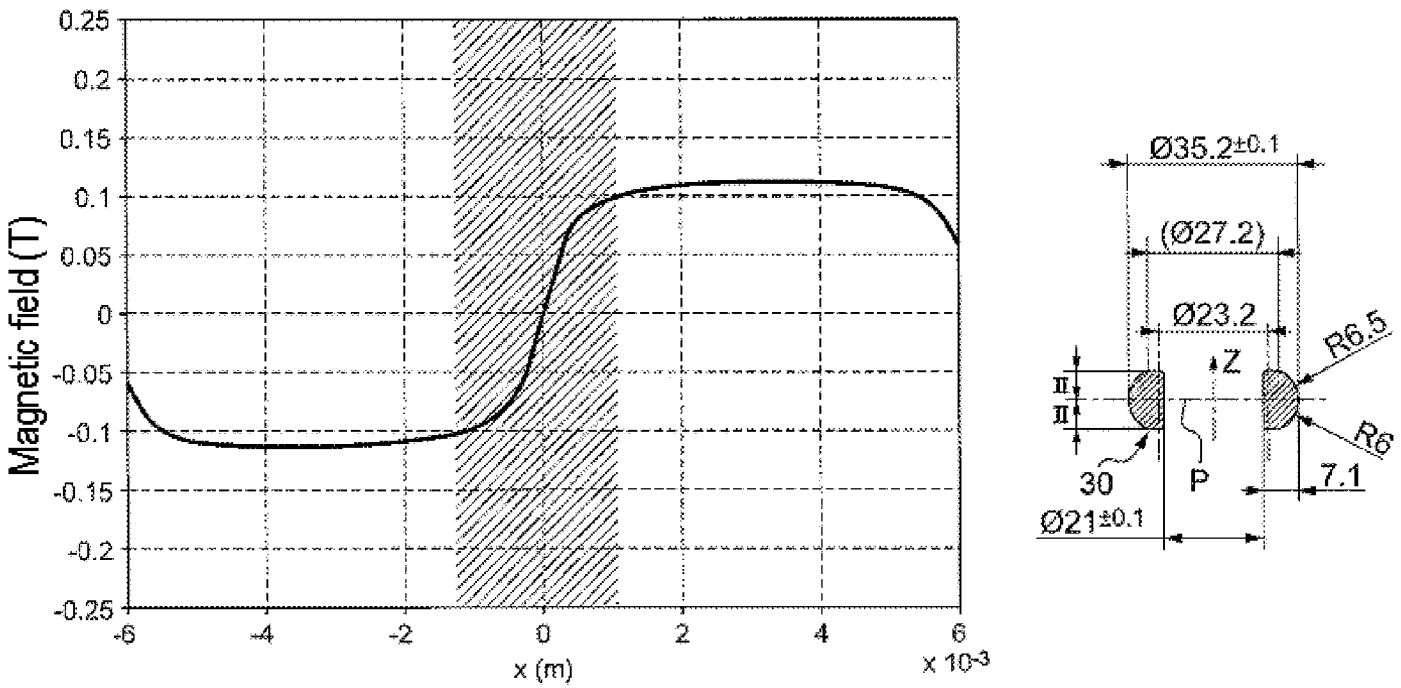
FIG. 1 shows a schematic cross-sectional view of a bonded-magnet annular magnetic motor according to the prior art as well as a corresponding graph showing the magnetic field created in the structure as a function of the height, and has already been described.
Figure 2:
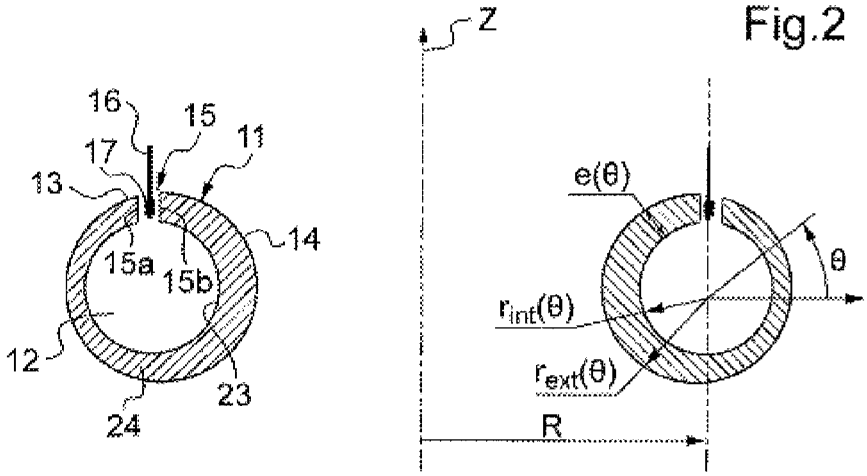
FIG. 2 shows schematically a cross-sectional view of the bonded-magnet annular structure forming the electrodynamic-transducer magnetic motor according to the present invention.

The example in FIG. 2 shows a cross section of a magnetic motor 10 consisting of a bonded magnet 11 made for example of plasto-magnetic material, in the form of a hollow annular structure, having a geometry with an axis of revolution Z.

Thus, the annular bonded magnet 11 with an axis of revolution Z forms a hollow solid body in contrast to the annular bonded magnets of the prior art which are in the form of solid bodies. The annular bonded magnet comprises an annular cavity 12, or recess, consisting of an internal hollow volume arranged inside the solid body of the annular bonded magnet 11 and bounded by an inner surface 23 of the annular bonded magnet 11, the intersection of which with an axial plane of the annular bonded magnet forms for example a circle. The annular bonded magnet 11 has an outer surface 14 which is radially at a distance from the inner surface 23 formed inside the solid body of the annular bonded magnet and is connected to the latter by a solid portion 24 of the annular bonded magnet 11, forming a thickness of residual magnetic material which is situated between the inner surface 23 and outer surface 14. The intersection of the outer surface 14 with an axial plane of said annular bonded magnet forms for example a circle.

By way of a variant, the intersection of the inner surface 23 and the outer surface 14 of the annular bonded magnet 11 respectively with an axial plane of the annular bonded magnet 11 forms an ellipse.

Owing to the presence of the annular cavity 12 it is advantageously possible to eliminate the non-useful magnetic mass at the center of the annular bonded magnet 11.

Moreover, the annular cavity 12 is connected to a top part 13 of the outer surface 14 of the annular bonded magnet 11 by a first annular channel 15 intended to form a first air gap. This first air gap forms a narrow space between the two vertical surfaces 15*a* and 15*b* of the bonded magnet, formed by the edges of the annular channel 15, where a first coil 17 mounted on a movable support 16 centered in this air gap may slide vertically. The magnetic field created inside the bonded magnet follows at every point the curvature of the circle (or ellipse) and escapes outside the magnet via the two vertical surfaces 15*a* and 15*b* defining the first air gap so that, in the region of the latter, the magnetization is perpendicular to the two surfaces 15*a* and 15*b* between which the moving coil 17 is intended to be arranged. This is equivalent to minimizing the angle between each surface 15*a*, 15*b* of the air gap and the coil support 16. In the optimum situation these three surfaces must be parallel.

Thus, the top part 13 of the outer surface 14 of the annular bonded magnet comprises a truncated zone leading into the annular cavity 12 through the solid portion 24 of the annular magnet 11, this truncated zone therefore having two cylindrical surfaces facing each other, referred to below as surfaces 15*a* and 15*b*, substantially parallel to the axis Z of revolution of the annular bonded magnet 11 and each extending respectively between the top part 13 of the outer surface 14 and the annular cavity 12, so as to form the annular channel 15 connecting the annular cavity 12 to the top part 13 of the outer surface 14 of the annular bonded magnet 11.

In this way, the magnetic field lines extend through the magnet, along an axial plane, following exactly the curvature defined by the circular (or elliptical) inner and outer surfaces and intersecting substantially perpendicularly the two facing cylindrical surfaces 15*a* and 15*b* of the annular channel 15. They thus cross radially the moving coil 17.

According to the example shown in FIG. 2, the bonded-magnet, hollow, annular structure forming the magnetic motor according to the invention forms an open hollow torus. In this example, this structure thus has a cross section with a circular form. In a particular embodiment, the bonded magnet could have an elliptical cross-section.

This structure may be obtained by means of injection-molding, for example by molding two single-piece assemblies which correspond to two parts of the annular bonded magnet situated opposite each other in relation to a plane of movement of the moving coil and are then assembled to form the hollow annular structure of the annular bonded magnet 11.

The optimization of the magnetic mass of the bonded-magnet magnetic structure is therefore based principally on the particular arrangement in the form of a hollow annular structure, allowing advantageously elimination of the non-useful magnetic mass at the center of the annular structure, made of plasto-magnetic material.

However, in addition to the advantage obtained by elimination of the non-useful magnetic mass at the center of the annular structure, an additional advantage in terms of mass may also be obtained by optimizing the form of the residual magnetic material remaining between the annular cavity 12 and the outer surface 14 of the hollow annular structure of the bonded magnet 11. The annular cavity 12 is thus configured to define a variable thickness of residual magnetic material between itself and the outer surface of the hollow annular structure along said outer surface. In other words, the solid portion 24 situated between the inner surface 23 bounding the annular cavity 12 inside the solid body of the annular bonded magnet 11 and the outer surface 13 of the annular bonded magnet is designed to have a variable thickness.

In particular, with reference to the notations used in FIG. 2, such an optimization consists in configuring the annular cavity 12 by varying the thickness e(θ) of residual magnetic material formed by the solid portion 24 of the annular bonded magnet comprised between the annular cavity 12 and the outer surface 14, as a function of the angle θ, such that the bonded magnet 11 has a cross section for passage of the magnetic flux which is constant along its vertical dimension, i.e. along a direction parallel to the axis of revolution Z of the annular bonded magnet 11. The cross section for passage of the flux is defined by the magnetic surface of the hollow annular structure of the bonded magnet sectioned along a plane perpendicular to the axis Z. The cross section for passage of the magnetic flux therefore corresponds to the magnetic surface resulting from intersection of the annular bonded magnet 11 with a plane perpendicular to the axis of revolution Z of the annular bonded magnet 11.

Optimization of the form of the residual magnetic material by modifying its thickness must ensure that the magnetic surface S is constant as a function of the flux, so as to maintain a constant magnetic surface for the entire height z of the motor.

To achieve this, the variation in thickness e(θ) as a function of the angle θ must obey the following law, with reference also to FIG. 2 for the notations used in the formula below:

$$S = 2\pi e(\theta)\left[R + \frac{r_{ext}(\theta) + r_{int}(\theta)}{2}\cos(\theta)\right]$$

where R=the radius of the moving coil intended to slide in the air gap between the surfaces 15*a* and 15*b;*

$r_{ext}(\theta)$=the outer "radius" of the hollow annular structure; and $r_{int}(\theta)$=the inner "radius" of the hollow annular structure.

The forms such as the outer radius or the inner radius is constant are the optimum forms from a manufacturing point of view. However, it is perfectly possible to envisage ellipsoidal forms.

In order to optimize as far as possible the efficiency of the motor it is desirable to avoid as far as possible sudden changes in curvature of the cross section. This is equivalent to minimizing (causing to tend towards zero) the second derivative of the curvature.

By thus optimizing the magnetic mass it is possible to guide the magnetic field in the bonded magnet and concentrate the latter on the "coil path" inside a very small air gap and thus limit greatly the leakage field compared to a conventional structure.

This structure is particularly advantageous for the applications of magnetic motors where it is required to create a strong magnetic field in the air gap with a small motor mass. In fact, with the hollow annular structure according to the invention it is possible to reduce the mass of the motor by 50 to 80% compared to a conventional motor.

By applying the principles illustrated above, according to the example of FIG. 2, the circles formed by the intersection of the axial plane of the annular bonded magnet 11 with respectively the inner surface 23 and the outer surface 14 of the annular bonded magnet 11 are eccentric, such that the solid portion 24 of the solid body of the annular bonded magnet 11 situated between the inner surface 23 bounding the annular cavity 12 inside the solid body of the annular bonded magnet 11 and the outer surface 13 has a variable thickness.

According to a variation of embodiment described with reference to FIG. 3, the magnetic motor 10 consists of a bonded magnet 11 comprising a hollow annular structure in the form of an open torus with a constant thickness. In other words, according to the example shown in FIG. 2, the circles formed by the intersection of the axial plane of the annular bonded magnet 11 with respectively the inner surface 23 and the outer surface 14 of the annular bonded magnet 11 are concentric, such that the solid portion 24 of the solid body of the annular bonded magnet 11 situated between the inner surface 23 bounding the annular cavity 12 inside the solid body of the annular bonded magnet 11 and the outer surface 13 has a constant thickness e. The hollow annular structure with a constant thickness could also be defined with an ellipsoidal cross section. According to this variation of embodiment, the annular cavity 12 is thus arranged at the center of the hollow annular structure so as to define a constant thickness e of residual magnetic material between the cavity and the outer surface of the annular structure. The parameters which can be varied are therefore the thickness e of the bonded magnet 11 and the inner radius r1 of the hollow annular structure. The minimum inner radius will determine the maximum displacement $X_{Max}$ of the coil 17 where $X_{Max}<2*r1$. Advantageously, the structure of the motor is thus more symmetrical and will be easier to manufacture. It is, however, less optimal in terms of the mass than the hollow annular structure with variable thickness described above with reference to FIG. 2.

Figure 4:
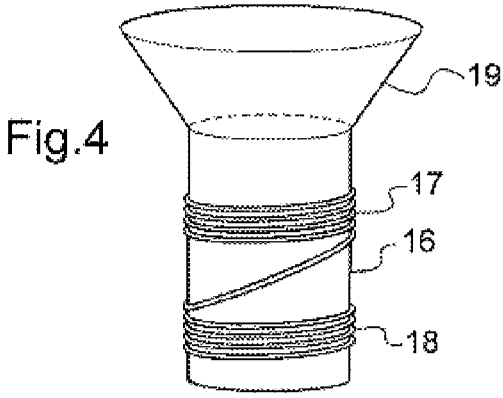
FIG. 4 shows schematically a configuration of the support of a moving coil with double windings.

The structure of the magnetic motor proposed by the invention may also be suitable for double-winding moving coils, as shown in FIG. 4. The moving-coil support 16 comprises in this configuration a first upper winding forming a first moving-coil winding 17 and a second lower winding forming a second moving-coil winding 18, a membrane 19 being fixed to the upper end of the moving-coil support. The first moving-coil winding 17 and the second moving-coil winding 18 axially spaced from each other consist of a single wire, but wound up in the reverse direction, so that the current flowing in the second winding 18 flows in the opposite direction to the current flowing in the first winding 17.

Figure 5:
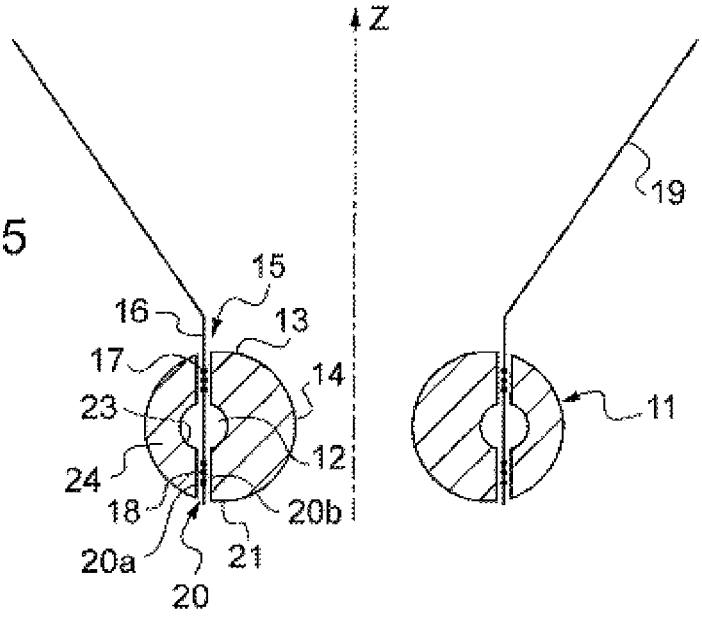
FIG. 5 shows schematically another variation of embodiment of the bonded-magnet annular structure according to the invention in which said bonded-magnet annular structure is designed so as to be suitable for double windings.

The magnetic motor structure 10 may be modified as shown in FIG. 5 in order to adapt it for electrodynamic transducers with a double-winding moving coil. In order to achieve this, a second annular channel 20 is provided between the annular cavity 12 and the outer surface 14 of the hollow annular structure, leading into a bottom part 21 of the outer surface, opposite to the top part 13 of this surface through which the first annular channel 15 emerges. The two annular channels 15 and 20 are aligned across the annular cavity 12 and form a first air gap and a second air gap, respectively, intended to receive the first moving-coil winding 17 and the second moving-coil winding 18 wound onto the movable support 16 centered in the two air gaps.

Thus, the bottom part 21 of the outer surface 14 of the annular bonded magnet 11, opposite the top part 13 of the outer surface 14 in relation to the mid-plane of the magnet 11, also comprises a truncated zone leading into the annular cavity 12 through the solid portion 24 of the annular magnet 11, this truncated zone therefore having two cylindrical surfaces 20*a* and 20*b* facing each other, substantially parallel to the axis Z of revolution of the annular bonded magnet 11 and each extending respectively between the bottom part 21 of the outer surface 14 and the annular cavity 12, so as to form the second annular channel 20 connecting the annular cavity 12 to the bottom part 21 of the outer surface 14 of the annular bonded magnet 11.

The two windings 17 and 18 are therefore arranged respectively perpendicularly with respect to the two facing cylindrical surfaces 15*a* and 15*b* of the first annular channel 15 and the two facing cylindrical surfaces 20*a* and 20*b* of the second annular channel 20, so that the two bundles of field lines passing through the two windings are oriented in directions opposite to each other. Thus, the forces which are exerted on the tubular elements are double, this increasing the power of the motor device.

Figure 3:
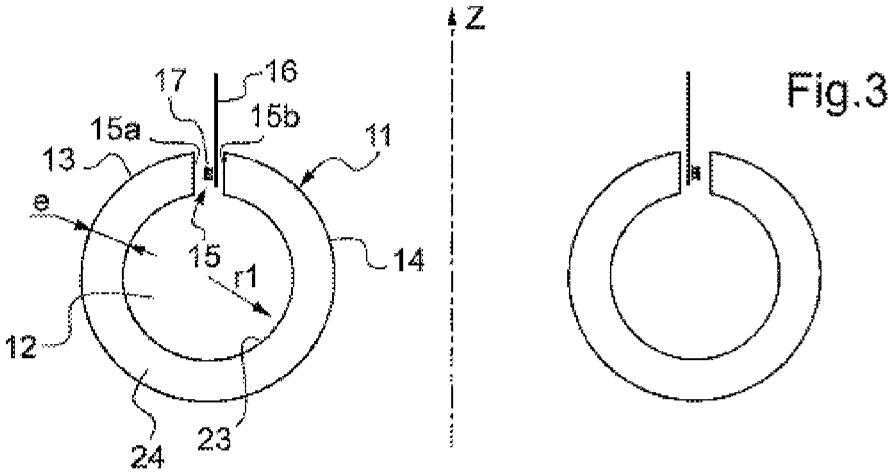
FIG. 3 shows schematically a variation of embodiment of the bonded-magnet annular structure according to the invention in which said bonded-magnet annular structure has a constant thickness.

In the case of a magnetic motor structure suitable for a moving coil with a single winding, as shown for example in FIGS. 2 and 3, the hollow annular structure is closed in its bottom part so as to guide better the field lines and thus limit the leakages into the air. In other words, the bottom part 21 of the outer surface 14 therefore does not comprise any truncated zone.

Figure 6:
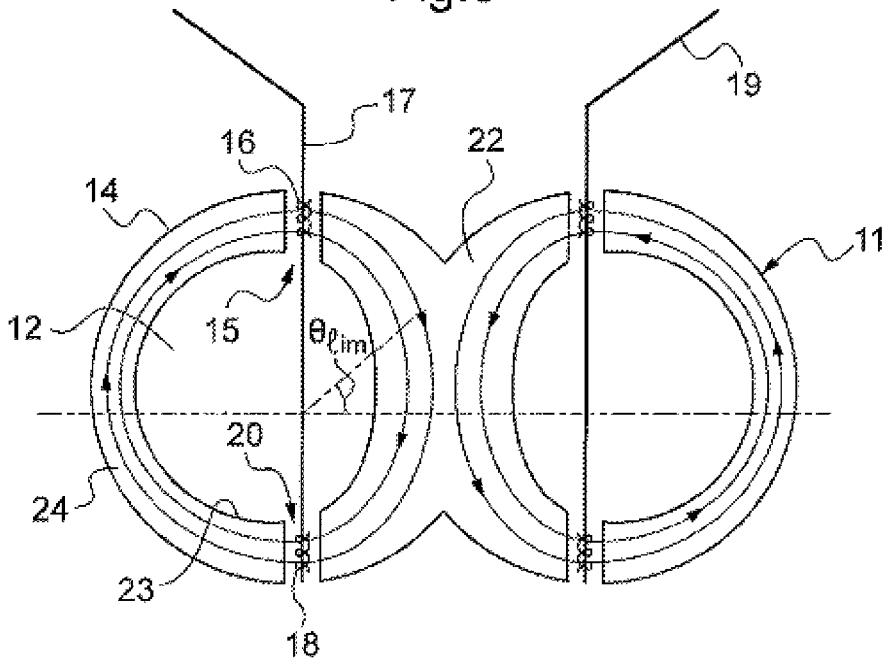
FIG. 6 shows schematically another variation of embodiment of the bonded-magnet annular structure according to the invention in which said bonded-magnet annular structure is designed for small-diameter windings.

FIG. 6 shows another variation of embodiment, in which the hollow annular structure of the motor 10 comprises a solid central core made of magnetic material 22 surrounded by the annular cavity 12. Thus, according to this variant, the solid portion 24 of the annular bonded magnet 11, which is arranged facing the axis of revolution Z of the annular bonded magnet 11, is designed to extend towards the central part of the annular bonded magnet 11 in the direction of the axis of revolution Z of the annular bonded magnet 11 so as to form the solid central core made of magnetic material 22. This variant is shown in the case of the figure with a double air gap. According to the example of FIG. 6, the hollow annular structure forms a closed hollow torus. However, the hollow annular structure according to this variant could also have an ellipsoidal cross section. The annular cavity 12 is formed such that the variation in residual magnetic thickness between the annular cavity 12 and the outer surface 14 of the structure obeys the same law, depending on the angle θ, as that defined further above with reference to FIG. 2. However, the outer radii $r_{ext}(\theta)$ join together at an angle $\theta_{lim}$ such that $$\theta_{lim} = a\cos\left(\frac{R}{r_{ext}(\theta)}\right).$$

This form is particularly advantageous for manufacturing motors for loudspeakers with small-diameter windings.

Independently of the different variations of embodiments described above, the top part 13 of the outer surface 14 of the hollow annular structure may be formed so as to have a substantially flat zone intended to facilitate assembly of the motor part with the frame.

Furthermore, in the case of the variation of embodiment shown in FIG. 6, it is possible to envisage an orifice (not shown) passing through the solid central core 22 from one side to the other, substantially along the axis of revolution Z, so as to form a decompression hole. This decompression hole serves to eliminate any constraint preventing displacement of the moving coil 17, due to compression of the air by the solid central core 22, which would result in non-linearity during operation thereof.

What is claimed is:

1. An electrodynamic-transducer magnetic motor device with a moving coil, the electrodynamic-transducer magnetic motor device comprising:

a magnetic circuit consisting of an annular bonded magnet, wherein said annular bonded magnet has a hollow annular structure;

said hollow annular structure comprising an outer surface and an annular cavity connected to a top part of the outer surface of said hollow annular structure by a first annular channel forming a first air gap and a first winding of the moving coil, the first winding positioned and configured to move in the air gap.

2. The device as claimed in claim 1, wherein the annular bounded magnet comprises an inner surface, the annular cavity is formed by an internal hollow volume arranged inside the solid body of the annular bonded magnet and bounded by the inner surface of the annular bonded magnet, said outer surface of the annular bonded magnet being radially at a distance from said inner surface of the annular bonded magnet and being connected to said inner surface by a solid portion of the annular bonded magnet forming a thickness of residual magnetic material between said inner surface bounding said annular cavity inside the solid body of the annular bonded magnet and said outer surface of the annular bonded magnet.

3. The device as claimed in claim 2, wherein the intersection of said inner surface and said outer surface of the annular bonded magnet, respectively, with an axial plane of the annular bonded magnet forms a circle.

4. The device as claimed in claim 2, wherein the intersection of said inner surface and said outer surface of the annular bonded magnet, respectively, with an axial plane of the annular bonded magnet forms an ellipse.

5. The device as claimed in claim 2, wherein said annular bonded magnet comprises a solid central core surrounded by said annular cavity.

6. The device as claimed in claim 5, wherein said solid portion of the annular bonded magnet is arranged substantially facing the axis of revolution of the annular bonded magnet, and extends towards the central part of the annular bonded magnet in the direction of said axis of revolution, so as to form said solid central core.

7. The device as claimed in claim 1, wherein said top part of said outer surface of the annular bonded magnet comprises a truncated zone leading into said annular cavity, said truncated zone having two cylindrical surfaces, facing each other substantially parallel to the axis of revolution of the annular bonded magnet and each extending respectively between said top part of said outer surface and said annular cavity so as to form said first annular channel connecting said annular cavity to said top part of said outer surface of the annular bonded magnet.

8. The device as claimed in claim 1, wherein the outer surface comprises a bottom part, and said annular cavity is connected to the bottom part of said outer surface of the annular bonded magnet, opposite said top part in relation to a mid-plane of the annular bonded magnet, by a second annular channel aligned with said first annular channel across said annular cavity and forming a second air gap inside which a second moving-coil winding can move.

9. The device as claimed in claim 8, wherein said bottom part of said outer surface of the annular bonded magnet comprises a truncated zone leading into said annular cavity, said truncated zone comprising two cylindrical surfaces facing each other, substantially parallel to an axis of revolution of the annular bonded magnet and each extending respectively between said bottom part of said outer surface and said annular cavity, so as to form said second annular channel connecting said annular cavity to said bottom part of said outer surface of the annular bonded magnet.

10. The device as claimed in claim 2, wherein said solid portion of the annular bonded magnet has a variable thickness so that said annular bonded magnet has a cross section for passage of the magnetic flux corresponding to a magnetic surface resulting from the intersection of the annular bonded magnet with a plane perpendicular to the axis of revolution of the annular bonded magnet, which is constant along a vertical dimension of said annular bonded magnet.

11. The device as claimed in claim 2, wherein said solid portion of the annular bonded magnet has a constant thickness.

12. The device as claimed in claim 1, wherein said top part of said outer surface of the annular bonded magnet comprises a substantially flat portion.

* * * * *